United States Patent [19]

Röck et al.

[11] 4,310,948

[45] Jan. 19, 1982

[54] HINGE WITH A TELESCOPIC ARM LEVER CLOSING DEVICE

[75] Inventors: Erich Röck, Höchst; Bernhard Mages, Dornbirn, both of Austria

[73] Assignee: Julius Blum Gesellschaft m.b.H., Höchst, Austria

[21] Appl. No.: 104,465

[22] Filed: Dec. 17, 1979

[30] Foreign Application Priority Data

Jan. 2, 1979 [AT] Austria ..... 5/79

[51] Int. Cl.[3] ..... E05D 11/10; E05D 3/06

[52] U.S. Cl. ..... 16/335; 16/288; 16/370

[58] Field of Search ..... 16/145, 163, 166, 180, 16/182, 183, 50

[56] References Cited

U.S. PATENT DOCUMENTS

| | | | |
|---|---|---|---|
| 4,083,082 | 4/1978 | Holmes | 16/180 X |
| 4,112,543 | 9/1978 | Röck et al. | 16/145 X |
| 4,138,766 | 2/1979 | Röck et al. | 16/145 |
| 4,166,307 | 9/1979 | Röck et al. | 16/163 |
| 4,226,001 | 10/1980 | Salice | 16/145 |

FOREIGN PATENT DOCUMENTS

| | | | |
|---|---|---|---|
| 2818735 | 11/1979 | Fed. Rep. of Germany | 16/145 |
| 2920156 | 11/1979 | Fed. Rep. of Germany | 16/145 |

*Primary Examiner*—James Kee Chi

*Attorney, Agent, or Firm*—Wenderoth, Lind & Ponack

[57] ABSTRACT

A hinge includes a hinge arm mounted on a mounting plate on a furniture side wall. A hinge casing is insertable into a bore in the door. The hinge casing and the hinge arm connected by two hinge links. The hinge has a closing mechanism activated by a spring which acts on one of the hinge links. This hinge link is a lever with two arms, one of which is telescopic.

9 Claims, 5 Drawing Figures

HINGE WITH A TELESCOPIC ARM LEVER CLOSING DEVICE

BACKGROUND OF THE INVENTION

1. Field of the Invention

The invention relates to a hinge comprising a closing mechanism acted upon by a spring, and a hinge arm and a hinge casing linked to each other by means of two hinge links. The hinge links are mounted on hinge axles on the hinge arm and on hinge axles in the hinge casing and forming a link quadrangle with the hinge axles. One of two hinge links is a two-arm lever.

2. Description of the Prior Art

Hinges of the above-mentioned kind are widely used in modern furniture construction. It is their task to provide a hinge joint between the door and the body of an article of furniture and, moreover, to hold the door in its closed position on the body of the article, thereby eliminating the necessity of providing a separate holding member, e.g. a snapping mechanism.

With hinges of the above-mentioned type, it is preferably provided that the door will be closed automatically, if the door is not fully closed, i.e. not fully moved into the closing plane.

Moreover, the hinge should not exert a closing pressure on the door when the door is in the open position, so that no unintentional closing of the door will occur and that no such closing pressure must counteracted throughout the entire path of the door when the door is opened.

SUMMARY OF THE INVENTION

It is the object of the invention to provide a hinge of the above-mentioned type which allows very low costs of production and which fulfils the above-indicated tasks to an optimum extent.

According to the invention, this object is achieved by making one arm of one hinge link a telescopic arm whose free, movable end rests against a pin or the like provided on the hinge arm, the telescopic arm being adapted to be compressed against the resistance of the spring.

It is preferably provided that the free end of the telescopic arm rests against the hinge axle of the second hinge link so that an actual hinge part is used as a supporting member.

One embodiment of the invention provides that the movable part of the telescopic arm has a recess into which a flange of that part of the telescopic arm which is mounted in bearings projects, whereby the first part of the telescopic arm is guided on the second part thereof. Thereby the two parts of the telescopic arm are guided in each other in a very simple manner. It is further provided that the torque which is produced, when closing the door, is transferred onto the two-arm hinge lever in an optimum manner.

A further embodiment of the invention provides that the spring is a compression spring in the form of a coil spring, the spring resting on the movable part of the telescopic arm and on the hinge axle of the telescopic arm. The coil spring is adapted to be inserted in a cylindrical recess in a telescopic arm of the hinge link. Thereby a very compact construction of the hinge is obtained.

A further embodiment provides that the spring is a torsion spring, one leg resting against the movable part of the telescopic arm and the other leg resting against the second arm of the hinge link.

In order to make a change from the active closing pressure to the stopping of the closing pressure as harmonious as possible and vice versa, it is preferably provided that the movable part of the telescopic arm has a curved supporting face which rests against the hinge axle of the other hinge link.

In the following various embodiments of the invention will be described in more detail with reference to the figures of the attached drawings.

DESCRIPTION OF THE PREFERRED EMBODIMENTS

Figure 1:
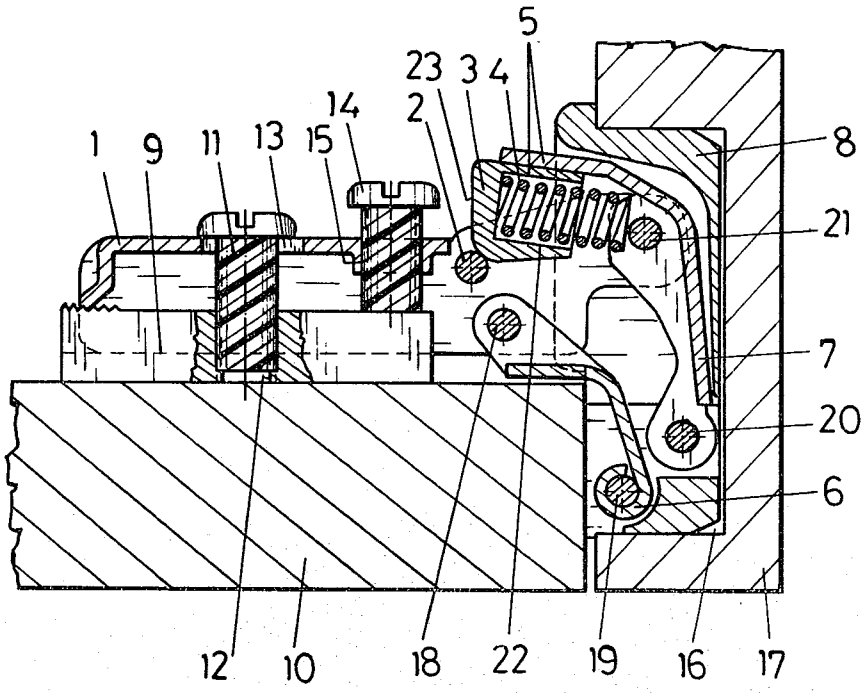
FIG. 1 is a schematic sectional view of a hinge according to the invention in the closed position.

The hinge according to the invention comprises a hinge arm 1 fastened to a side wall 10 of an article of furniture by means of a mounting plate 9. The hinge arm 1 is held on the mounting plate 9 by a screw 11. Screw 11 engages a female thread 12 of the mounting plate and extends through a slot 13. An adjustment of the hinge arm 1 in the direction of the depth of the piece of furniture can be made over the length of slot 13.

An adjusting screw 14 for joint adjustment is provided on the side of the furniture door, such adjusting screw being mounted in a female thread 15 of the hinge arm 1 and resting against the mounting plate 9.

The hinge arm 1 is linked to a hinge casing 8 by means of two hinge links 6, 7, the hinge casing engaging a bore 16 of a furniture door 17. The hinge links 6, 7 are mounted on hinge axles 18, 19, 20, 21. Hinge axles 18 and 21 are arranged on the hinge arm and hinge axles 19 and 20 are arranged in the hinge casing 8.

Figure 2:
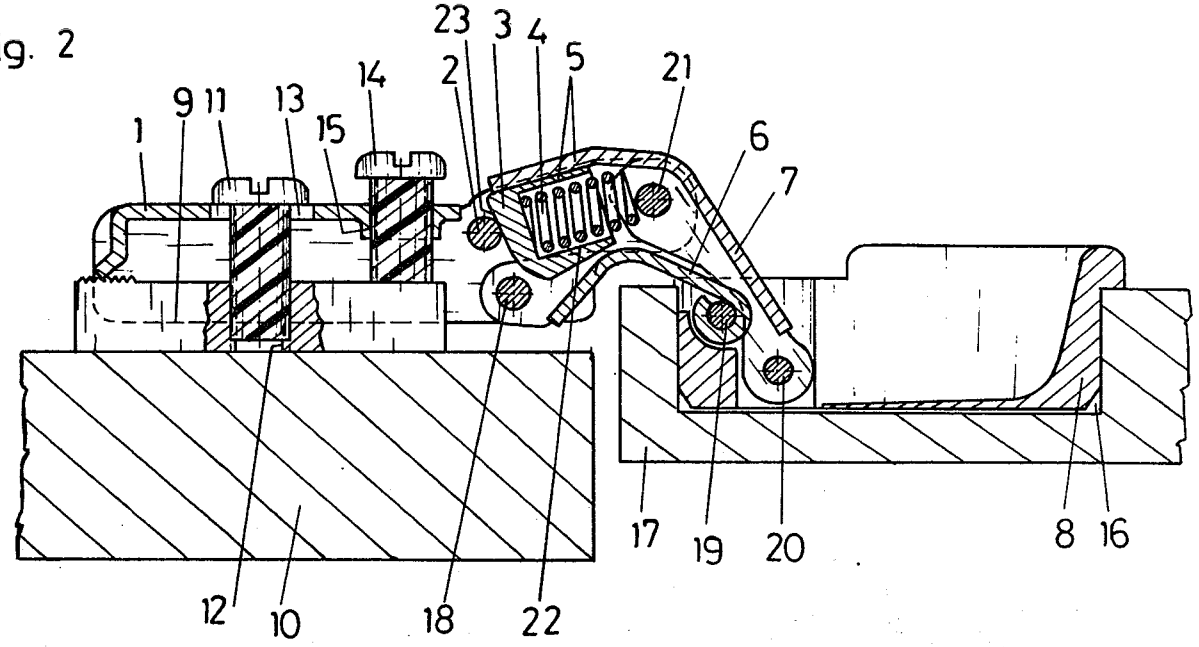
FIG. 2 is a view similar to FIG. 1, but in the open position of the hinge.

The hinge link 7 is a two-arm lever, one of arms thereof connecting the two hinge axles 21, 20 and the second of the arms, which is a telescopic arm 5, being directed towards the hinge arm 1 and freely projecting over the hinge axle 21. As can be seen in the embodiment according to FIGS. 1 and 2 of the drawings, a free end 3 of the telescopic arm 5 rests against a pin 2 of the hinge arm 1. The free end 3 is pressed against the pin 2 by a spring, e.g. a coil spring according to this embodiment. The spring 4 first abuts against the free end 3 of the telescopic arm 5 and against the hinge axle 21.

In order to provide a better support for the spring 4, a cylindrical recess 22 is provided in the free end 3 of the telescopic arm 5, the spring 4 being arranged in such cylindrical recess.

The free end 3 of the telescopic arm 5 is provided with a curved guiding face or edge 23, which rests against the pin 2.

Figure 3:
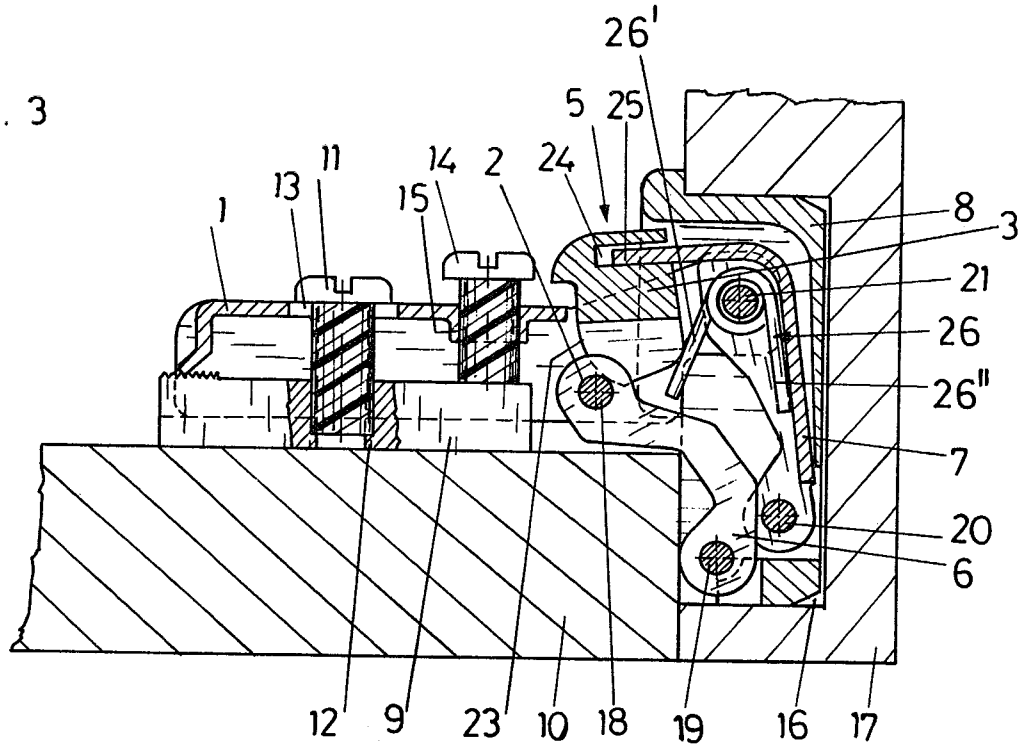
FIGS. 3 and 4 are schematic sectional views of further embodiments of hinges according to the invention, in the closed positions thereof

In the embodiment according to FIG. 3 the spring acting upon the free end 3 of the telescopic arm 5 is a torsion spring 26, one leg 26' of such spring resting against free end 3 and the second leg 26'' resting against the hinge link 7. The spring 26 is coiled around the hinge axle 21 and, thus, is securely held on the hinge arm 1.

In order to provide a better guiding of the free end 3 of the telescopic arm 5, the free end is provided with a slot-like recess 24 into which a flange 25 of the other part of the telescopic arm projects.

According to this embodiment the free end 3 of the telescopic arm 5 does not rest against a separate pin 2 of the hinge arm 1, but directly rests against the hinge axle 18 of the hinge link 6 and of the hinge arm 1.

Figure 4:
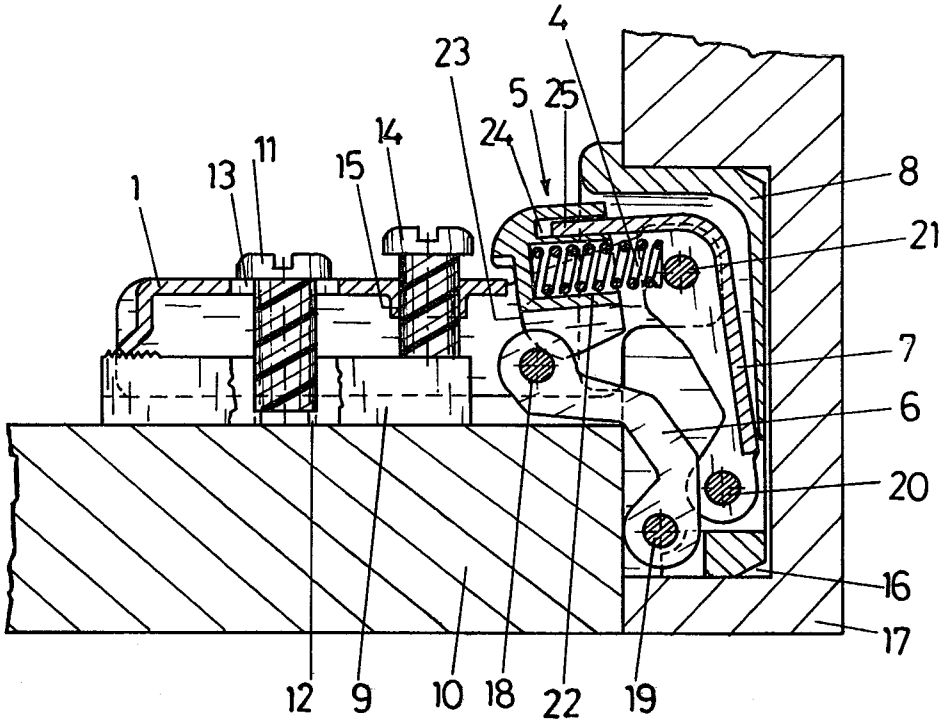
Figure 5:
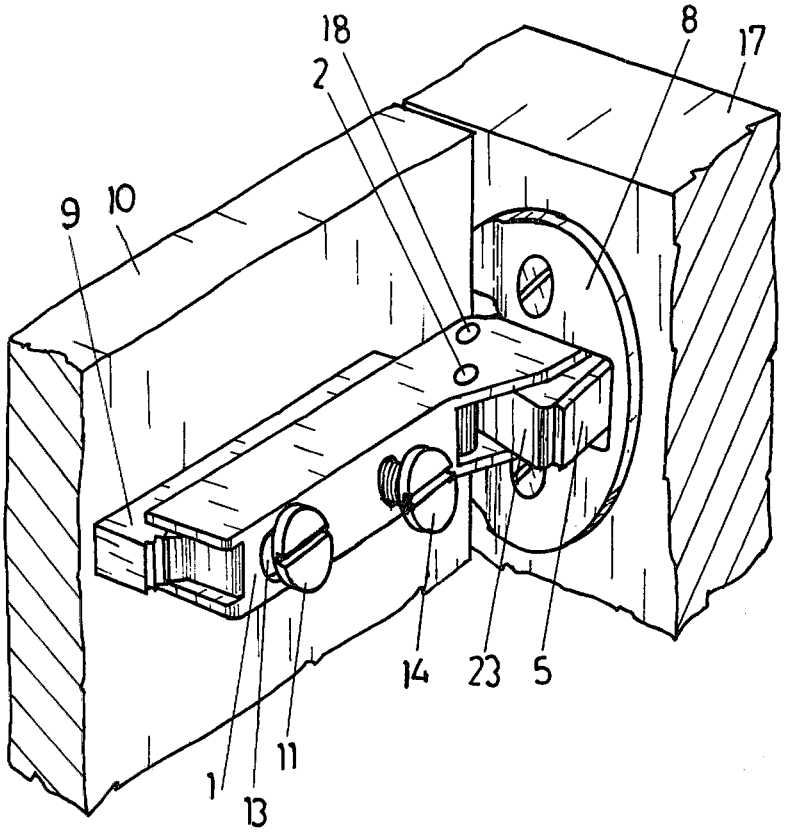
FIG. 5 is a perspective view of the hinge according to the invention.

The embodiment according to FIG. 4 is somewhat a combination of the two afore-described embodiments. According to this embodiment the free end 3 of the telescopic arm 5 rests against the hinge axle 18. The spring is a coil spring 4, which rests against the free end 3 and against the hinge axle 21.

The free end 3 of the telescopic arm 5 is again provided with a slot-shaped recess 24 into which a flange 25 of the other part of the telescopic arm extends. The coil spring 4 is mounted in a cylindrical recess 22, as already provided in the afore-mentioned embodiment.

The hinges according to the three illustrated embodiments function in the same manner. When the furniture door 17 is opened beyond a certain angle, the torque which is exerted on the hinge link 7 by the springs 4, 26, when the hinge is in the closed position, is stopped. This is due to the position of the pin 2 or of the hinge axle 18 on the guiding face or edge 23 of the movable end 3 of the telescopic arm 5. Thereby the furniture door 17 can be freely pivoted. Due to the length of the lever arm formed by the door 17, friction between the pin 2 or the hinge axle 18 and the free end 3 of the telescopic arm 5 can be neglected.

What is claimed is:

1. A hinge comprising:

a hinge arm adapted to be mounted on an article of furniture, said hinge arm having fixed thereto first and second hinge axles;

a hinge casing adapted to be mounted on a door of the article of furniture, said hinge casing having fixed thereto third and fourth hinge axles;

a first hinge link pivotally mounted about said first and third hinge axles;

a second hinge link pivotally mounted about said second and fourth hinge axles;

said second hinge link comprising a two-arm lever including a first arm extending between said second and fourth hinge axles and a second arm directed toward said hinge arm;

said second arm comprising a telescopic arm including a movable end member;

spring means mounted in contact with said end member for moving said end member in a direction away from said first arm of said two-arm lever; and said end member being abutted against a fixed portion of said hinge arm by the force of said spring means.

2. A hinge as claimed in claim 1, wherein said end member has therein a recess, and said second telescopic arm includes a flange integral with said first arm and slidably extending into said recess, thereby guiding movement of said end member.

3. A hinge as claimed in claims 1 or 2, wherein said spring means comprises a compression spring having a first end abutting said end member and a second end abutting said second hinge axle.

4. A hinge as claimed in claim 3, wherein said end member has therein a cylindrical recess, said first end of said spring extending into said cylindrical recess.

5. A hinge as claimed in claims 1 or 2, wherein said spring means comprises a torsion spring having a first leg abutting said end member and a second leg abutting said first arm.

6. A hinge as claimed in claim 5, wherein said torsion spring is freely mounted about said second hinge axle.

7. A hinge as claimed in claim 1, wherein said fixed portion of said hinge arm comprises said first hinge axle.

8. A hinge as claimed in claim 1, wherein said fixed portion of said hinge arm comprises a pin fixed to said hinge arm.

9. A hinge as claimed in claims 1, 2, 7 or 8, wherein said end member has a curved surface abutting against said fixed portion of said hinge arm.

* * * * *